US007965856B2

(12) United States Patent
Sato et al.

(10) Patent No.: US 7,965,856 B2
(45) Date of Patent: Jun. 21, 2011

(54) SPEAKER UNIT

(75) Inventors: Hiroshi Sato, Kyoto (JP); Chisato Tsujii, Osaka (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 1156 days.

(21) Appl. No.: 11/699,392

(22) Filed: Jan. 30, 2007

(65) Prior Publication Data

US 2007/0189575 A1 Aug. 16, 2007

(30) Foreign Application Priority Data

Feb. 1, 2006 (JP) ..... 2006-024216

(51) Int. Cl.
*H04R 25/00* (2006.01)

(52) U.S. Cl. ..... 381/396; 381/400; 381/420

(58) Field of Classification Search ..... 381/396, 381/400, 407, 412, 420–422, 424, 433
See application file for complete search history.

(56) References Cited

U.S. PATENT DOCUMENTS

| | | | | |
|---|---|---|---|---|
| 5,727,077 | A * | 3/1998 | Frasl | 381/396 |
| 6,795,564 | B2 * | 9/2004 | Zhang | 381/420 |
| 7,149,322 | B2 * | 12/2006 | Kuribayashi et al. | 381/412 |

FOREIGN PATENT DOCUMENTS

| | | | |
|---|---|---|---|
| JP | 48-14418 | U | 4/1973 |
| JP | 55-150593 | U | 10/1980 |
| JP | 62-121900 | U | 8/1987 |
| JP | 63-113397 | U | 7/1988 |
| JP | 2-123199 | U | 10/1990 |
| JP | 4-34639 | Y2 | 8/1992 |
| JP | 06-296300 | A | 10/1994 |
| JP | 07-111697 | A | 4/1995 |
| JP | 08-051696 | A | 2/1996 |
| JP | 08-079866 | A | 3/1996 |
| JP | 9-65485 | A | 3/1997 |
| JP | 10-004600 | A | 1/1998 |
| JP | 10-164691 | A | 6/1998 |
| JP | 11-027794 | A | 1/1999 |
| JP | 2003-153384 | A | 5/2003 |
| JP | 2003-319492 | A | 11/2003 |

OTHER PUBLICATIONS

Japanese Office Action dated Sep. 1, 2010, issued in corresponding Japanese Patent Application No. 2006-024216.

Japanese Office Action dated Feb. 1, 2011, issued in corresponding Japanese Patent Application No. 2006-024216. (partial English translation).

* cited by examiner

*Primary Examiner* — Suhan Ni
(74) *Attorney, Agent, or Firm* — Westerman, Hattori, Daniels & Adrian, LLP

(57) ABSTRACT

A speaker unit of the present invention includes a frame made of a synthetic resin, inside which a voice coil is disposed in a space between a pole piece and a yoke. A diaphragm is coupled to the voice coil. A pair of lead wires extending from the voice coil are passed between the yoke and the diaphragm, and led out of the frame. The frame has a receiving surface for receiving collisions of the lead wires due to vibrations of the diaphragm, which is formed outer than an end face of the yoke opposed to the diaphragm, and closer to the diaphragm than the end face.

4 Claims, 4 Drawing Sheets

SPEAKER UNIT

The priority application Number 2006-024216 upon which this patent application is based is hereby incorporated by reference.

BACKGROUND OF THE INVENTION

1. Field of the Invention

The present invention relates to speaker units mounted in small electronic devices such as personal computers and portable telephones.

2. Description of Related Art

As shown in FIG. 5, a conventional speaker unit includes a speaker device accommodated in a frame 21 made of a synthetic resin. The speaker device includes a magnet 6, and a pole piece 7 and a yoke 5 disposed on opposite polar faces of the magnet 6. A coil piece 91 of a voice coil 9 is disposed in a magnetic field formed between the pole piece 7 and the yoke 5.

The frame 21 has openings 24, 25 at opposite ends in an acoustic wave generating direction of the speaker device. One of the openings 25 is closed with a vibration wall 20. The vibration wall 20 includes a ring-shaped diaphragm 3, and a dust proof 4 that closes an opening of the diaphragm 3 and is coupled to the diaphragm 3. The diaphragm 3 is coupled at its inner periphery to a coil core 92 of the voice coil 9. The diaphragm 3 is pinched at its outer periphery between a peripheral edge of the one opening 25 of the frame 21 and a ring-shaped frame body 2, and fixed to the frame 21.

The other opening 24 of the frame 21 is closed with the yoke 5. The yoke 5 is in the form of a bottomed cylinder having integrally formed bottom 50 and cylinder 51, and fixed with an outer surface of the cylinder 51 of the yoke 5 being in close contact with an inner surface of the other opening 24 of the frame 21. In the frame 21, an end face 53 of the cylinder 51 of the yoke 5 is exposed from the other opening 24. The end face 53 is formed flush with an inner surface 27 of the frame 21.

A pair of lead wires 90, 90 for powering the voice coil 9 extend from the voice coil 9. The lead wires 90, 90 are passed between the end face 53 of the cylinder 51 of the yoke 5 and the vibration wall 20, and led out of the frame 21 (see, for example, JP 9-65485, A).

When the voice coil 9 is powered, the voice coil 9 vibrates as shown in FIG. 6. Its amplitude becomes larger with increase of power applied to the voice coil 9. When a prescribed maximum power is applied to the voice coil 9, the voice coil 9 vibrates at a prescribed maximum amplitude corresponding to the prescribed maximum power. At this time, the voice coil 9 comes closest to the bottom 50 of the yoke 5, so that the lead wires 90, 90 will accordingly come closest to the end face 53 of the yoke 5.

If the power supplied to the voice coil 9 contains noise and thereby exceeds the prescribed maximum power, the voice coil 9 vibrates at an amplitude exceeding the prescribed maximum amplitude, and brings the lead wires 90, 90 into contact with the end face 53 of the yoke 5. This can cause short circuit between the yoke 5 and the voice coil 9 to thereby damage the speaker unit or an externally connected drive amplifier.

Accordingly, a dimension more than a maximum displacement magnitude (saturation displacement magnitude), at which the amplitude of the voice coil 9 stops increasing even if the power applied to the voice coil 9 increases, is secured for a distance W' between the lead wires 90, 90 and the end face 53 of the yoke 5 in a non-powered state of the voice coil 9, such that the lead wires 90, 90 will not collide with the end face 53 of the yoke 5 even if the voice coil 9 vibrates at an amplitude exceeding the prescribed maximum amplitude.

In recent years, the amplitude of the voice coil 9 has been increasing in order to provide high sound quality and high sound pressure. On the other hand, thinner speaker units have been desired as electronic devices have been made thinner. However, with the conventional speaker unit shown in FIG. 5, if a distance D' from the outer surface of the bottom 50 of the yoke 5 to the top end of the frame body 2 is made thinner with the cylinder 51 of the yoke 5 and the coil core 92 of the voice coil 9 having smaller height dimensions, the distance between the lead wires 90, 90 and the yoke 5 is narrower as shown in FIG. 7. This has caused a problem in that, if the voice coil 9 vibrates at an amplitude exceeding the prescribed maximum amplitude, the lead wires 90, 90 collide with the end face 53 of the yoke 5 to cause short circuit between the yoke 5 and the voice coil 9. On the other hand, there has been another problem in that a smaller prescribed maximum amplitude of the voice coil 9 could not provide high sound quality and high sound pressure.

SUMMARY OF THE INVENTION

An object of the present invention is to provide a highly reliable speaker unit that can be made thinner without causing short circuit between the yoke and the voice coil even if the lead wires for powering the voice coil come close to the yoke.

The speaker unit of the present invention includes a speaker device 8, and a frame 1 made of a synthetic resin and having an opening in an acoustic wave generating direction of the speaker device 8 to accommodate the speaker device 8. The speaker device 8 includes a magnet 6; a pole piece 7 and a yoke 5 disposed on opposite polar faces of the magnet 6; an annular space S defined by an outer peripheral surface of the pole piece 7 having a central axis parallel to the acoustic wave generating direction and an inner peripheral surface of the yoke 5, which are opposed to each other; a cylindrical voice coil 9 placed in the space S; and a diaphragm 3 that is coupled to the voice coil 9 and vibrates in the acoustic wave generating direction. The diaphragm 3 has an inner periphery 31 thereof coupled to one end of the voice coil 9, and the diaphragm 3 has an outer periphery 32 thereof coupled to the frame 1, the voice coil 9 having a pair of lead wires 90, 90 extended therefrom, passed between the yoke 5 and the diaphragm 3, and led out of the frame 1. The frame 1 has a receiving surface 11 for receiving collisions of the lead wires 90, 90 due to vibrations of the diaphragm 3, which is formed outer than an end face of the yoke 5 opposed to the diaphragm 3, and closer to the diaphragm 3 than the end face 53.

With the above speaker unit of the present invention, even if the lead wires 90, 90 come close to the yoke 5, the lead wires 90, 90 are received by the receiving surface 11, and thereby prevented from being further displaced. Therefore, the lead wires 90, 90 will not come into contact with the end face 53 of the yoke 5. This can prevent failure due to short circuit between the yoke 5 and the voice coil 9 and damage of an externally connected drive amplifier. Thus, the unit can be made thinner but highly reliable.

Further specifically, the frame 1 is formed cylindrically, the frame 1 having an inner peripheral surface thereof formed with a flange 12 projecting toward the end face 53 of the yoke 5, and the receiving surface 11 is defined on a surface of the flange 12 opposed to the diaphragm 3. Because the receiving surface 11 of the frame 1 is adjacent to the end face 53 of the yoke 5, this specific configuration can provide a smaller height from the end face 53 of the yoke 5 to the receiving surface 11 than that in the case where the receiving surface 11 is away from the end face 53 of the yoke 5, and can contribute to making the speaker unit thinner.

Specifically, the yoke 5 is formed in the form of a bottomed cylinder having a cylinder 51 and a bottom 50, the cylinder 51 having an inner peripheral surface thereof opposed to an outer peripheral surface of the pole piece 7, and has the end face 53 on an open end of the cylinder 51, and the magnet 6 is placed on an inner surface of the bottom 50.

Further specifically, a distance W between the lead wires 90 and the receiving surface 11 at the time when the voice coil 9 is in a nonconductive state to give a displacement magnitude of zero is set larger than a prescribed maximum displacement magnitude given by a prescribed maximum power supplied to the voice coil 9, and smaller than a saturation value of displacement magnitude given to the voice coil 9 by supply of an excessive power exceeding the prescribed maximum power.

This specific configuration can provide high sound quality and high sound pressure because, in a normally driven state where the voice coil 9 is powered in a prescribed range, the lead wires 90 will not collide with the receiving surface 11, and will not prevent the voice coil 9 from vibrating. In addition, the unit can be made thinner than that in which a distance corresponding to a saturation value of displacement magnitude given to the voice coil 9 is secured between the lead wires 90 and the yoke 5.

As described above, the speaker device of the present invention can be made thinner but highly reliable, because the lead wires for powering the voice coil will not come into contact with the end face of the yoke to cause short circuit between the yoke and the voice coil even if the lead wires come close to the yoke.

DETAILED DESCRIPTION OF THE INVENTION

Figure 1:
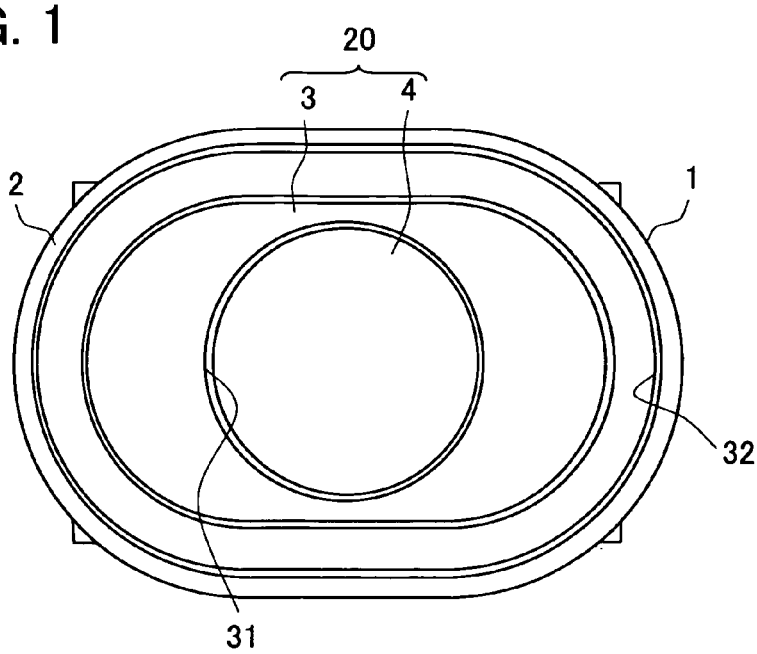
FIG. 1 is a plan view of a speaker unit of the present invention.

An embodiment of the present invention will be specifically described below with reference to the drawings. FIG. 1 to FIG. 4 show a speaker unit of the present invention. As shown in FIG. 3, a speaker device 8 is accommodated in a frame 1 made of a synthetic resin. The speaker device 8 includes a magnet 6, and a pole piece 7 and a yoke 5 disposed on opposite polar faces of the magnet 6.

The magnet 6 is accommodated in the yoke 5 formed in the form of a bottomed cylinder. The yoke 5 has a circular bottom 50, and a cylinder 51 projecting from the entire periphery of an outer edge of the bottom 50, which are formed integrally. One polar face of the magnet 6 is disposed on an inner surface of the bottom 50. The cylinder 51 surrounds the magnet 6. The pole piece 7 is disposed on the other polar face of the magnet 6. The cylinder 51 of the yoke 5 surrounds the pole piece 7. A magnetic field is formed in an annular space S defined by an outer peripheral surface of the pole piece 7 and an inner peripheral surface of the cylinder 51 of the yoke 5 opposed to each other.

A voice coil 9 includes a cylindrical coil core 92, and a coil piece 91 wound around an outer peripheral surface of the coil core 92. The coil piece 91 is not wound around one end of the voice coil 9, so that an outer surface of the coil core 92 is partly exposed. The coil piece 91 of the voice coil 9 is disposed in the space S between the yoke 5 and the pole piece 7.

As show in FIG. 1, a vibration wall 20 of the speaker device 8 includes a ring-shaped diaphragm 3 and a dust proof 4 for closing an opening of the diaphragm 3. The dust proof 4 is coupled at an outer periphery thereof to an inner periphery 31 of the diaphragm 3. The inner periphery 31 of the diaphragm 3 is coupled to the end of the voice coil 9 where the outer surface of the coil core 92 is exposed.

Figure 2:
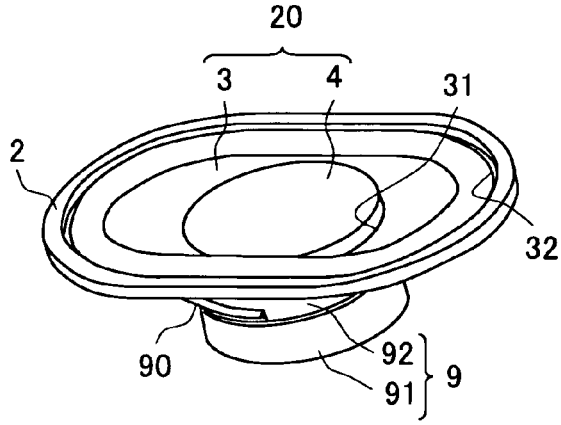
FIG. 2 is an exploded perspective view of the speaker unit of the present invention.
Figure 2:
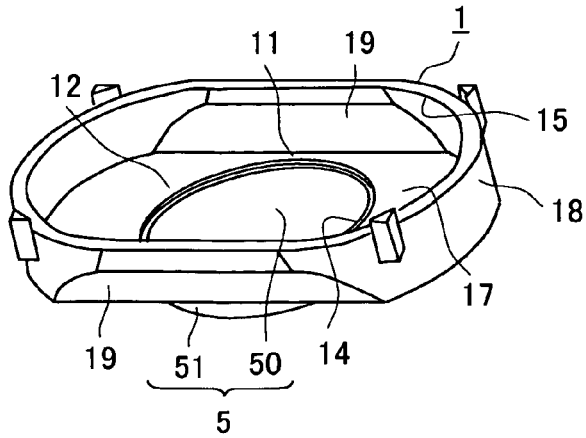
Figure 3:
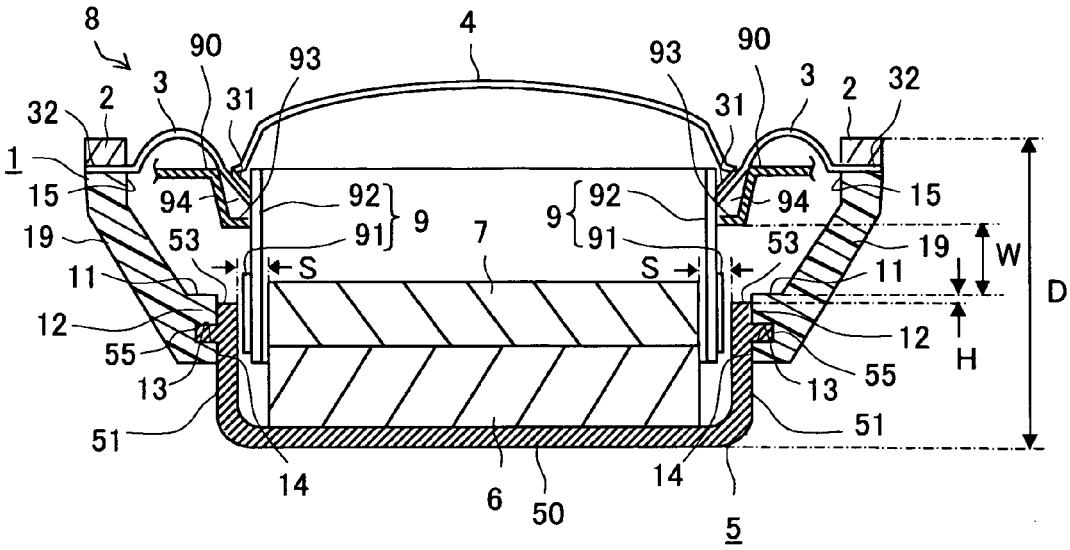
FIG. 3 is a sectional view of the speaker unit of the present invention.

As show in FIG. 2, the frame 1 is in the form of a bottomed cylinder having integrally formed bottom wall 17 and peripheral wall 18. The peripheral wall 18 of the frame 1 has an approximately elliptical outer shape, and projects from the entire periphery of an outer edge of the bottom wall 17. The peripheral wall 18 has a pair of slopes 19, 19 sloping such that the frame 1 expands in minor axis dimension from the bottom wall 17 toward the top end of the peripheral wall 18. The slopes 19, 19 are provided oppositely in the minor axis direction of the peripheral wall 18. Projections for positioning the diaphragm 3 relative to the frame 1 are provided at four locations on an outer surface of the peripheral wall 18 of the frame 1.

A first opening 15 surrounded by the top end of the peripheral wall 18 of the frame 1 is closed with the vibration wall 20. An outer periphery 32 of the diaphragm 3 constituting the vibration wall 20 is pinched between a ring-shaped frame body 2 and the top end of the peripheral wall 18 of the frame 1, and fixed to the frame 1. A second circular opening 14 is provided in the middle of the bottom wall 17 of the frame 1. The second opening 14 is closed with the yoke 5 of the speaker device 8.

As shown in FIG. 3, an outward projecting projection 55 is provided on an outer surface of the cylinder 51 of the yoke 5. The projection 55 is formed extending entirely circumferentially of the cylinder 51. On the other hand, a flange 12 for fixing the yoke 5 is provided on the entire periphery of an outer edge of the second opening 14 of the bottom wall 17 of the frame 1. The flange 12 is provided with a recess 13 depressed from an inner peripheral surface of the second opening 14. The recess 13 extends entirely circumferentially of the second opening 14.

The cylinder 51 of the yoke 5 is inserted into the second opening 14 of the frame 1. The bottom 50 of the yoke 5 projects outward from the second opening 14 of the frame 1. The projection 55 provided on the cylinder 51 of the yoke 5 is fitted in the recess 13 provided in the flange 12 of the frame 1 to fix the yoke 5 to the frame 1. The inner surface of the opening 14 of the frame 1 and the outer surface of the cylinder 51 of the yoke 5 are in close contact with each other.

In the frame 1, an end face 53 of the cylinder 51 of the yoke 5 is depressed from the inner surface of the bottom wall 17 of the frame 1. That is, the inner surface of the flange 12 of the frame 1 provided on the entire periphery of an outer edge of the end face 53 of the yoke 5 is formed closer to the diaphragm 3 than the end face 53 of the yoke 5. A receiving surface 11 for receiving collisions of lead wires 90, 90 due to vibrations of the vibration wall 20, as described later, is defined on the inner surface of the flange 12 of the frame 1.

A pair of lead wires 90, 90 for powering the voice coil 9 are connected to the coil piece 91 of the voice coil 9. The lead wires 90, 90 are led out of the frame 1. Tinsel wires having a plurality of twisted threads each having a thin copper foil wound therearound are used for the lead wires 90, 90.

Base portions 93, 93 of the lead wires 90, 90 on the voice coil 9 project from the part where the outer surface of the coil core 92 of the voice coil 9 is exposed toward the inner surface of the slopes 19, 19 of the frame 1, and are bonded to the inner periphery 31 of the diaphragm 3 with an adhesive 94, and fixed approximately perpendicularly with the axial direction of the voice coil 9. The base portions 93, 93 of the lead wires 90, 90 pass between the diaphragm 3 and the end face 53 of the yoke 5, and lead between the diaphragm 3 and the inner surface of the flange 12 of the frame 1.

When the voice coil 9 is non-powered to give a displacement magnitude of zero, a distance W larger than a prescribed maximum displacement magnitude of the voice coil 9 described later is provided between the base portions 93, 93 of the lead wires 90, 90 and the receiving surface 11 provided on the frame 1. When the voice coil 9 is powered, the voice coil 9 vibrates between the vibration wall 20 and the bottom 50 of the yoke 5, whereby the vibration wall 20 vibrates to generate acoustic waves.

Figure 8:
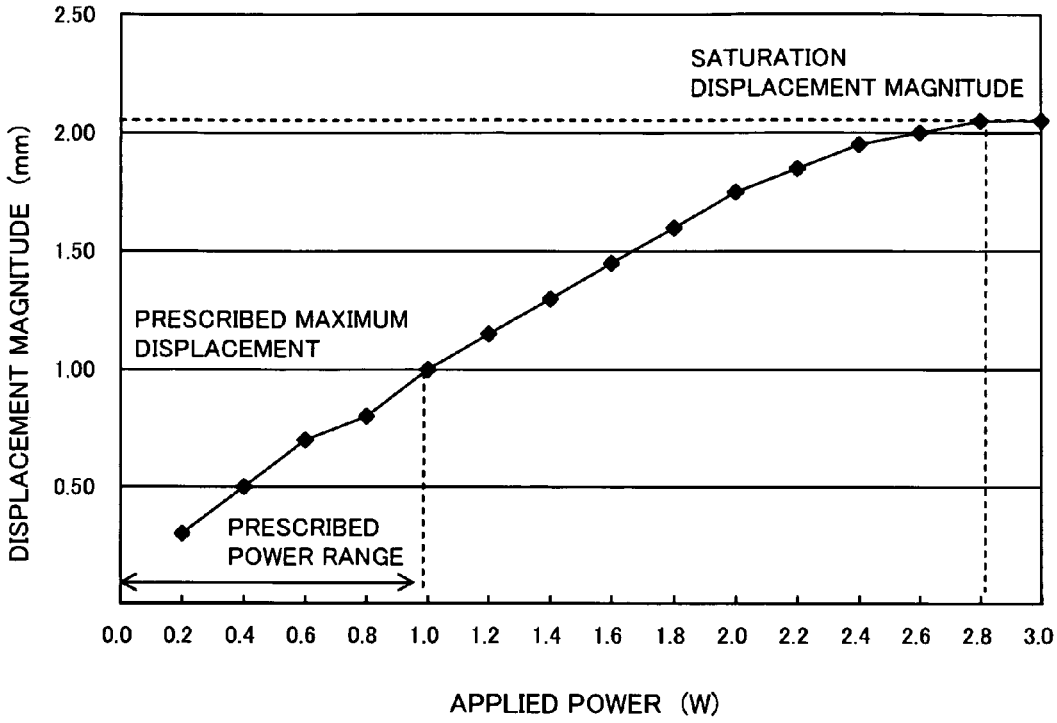
FIG. 8 is a graph showing vibration characteristics of a voice coil.

FIG. 8 shows a graph of vibration characteristics of the voice coil 9. As shown in the graph, the displacement magnitude of the voice coil 9 from the non-powered state toward the yoke 5 increases with increase of power applied to the voice coil 9. In a normal drive, a power in a prescribed range is applied to the voice coil 9, and the voice coil 9 vibrates at an amplitude in a prescribed range.

When a prescribed maximum power is applied to the voice coil 9, the voice coil 9 and the lead wires 90, 90 vibrate at a prescribed maximum amplitude. At this time, the voice coil 9 and the lead wires 90, 90 move from the non-driven state toward the yoke 5 by the prescribed maximum displacement magnitude, so that the voice coil 9 comes closest to the bottom 50 of the yoke 5, and the base portions 93, 93 of the lead wires 90, 90 come closest to the end face 53 of the yoke 5 and to the receiving surface 11 provided on the frame 1.

As described above, the distance W between the base portions 93, 93 of the lead wires 90, 90 and the receiving surface 11 provided on the frame 1 in a non-powered state of the voice coil 9 is formed larger than the prescribed maximum displacement magnitude of the voice coil 9 toward the yoke 5. Therefore, the lead wires 90, 90 will not collide with the receiving surface 11 of the frame 1.

The distance W between the lead wires 90, 90 and the receiving surface 11 provided on the frame 1 is larger than the prescribed maximum displacement magnitude of the voice coil 9, and has a margin dimension over the prescribed maximum displacement magnitude. Therefore, even if variations occur in distance dimension between the base portions 93, 93 of the lead wires 90, 90 and the receiving surface 11, or even if variations occur in vibration of the voice coil 9, the lead wires 90, 90 do not collide with the receiving surface 11 provided on the frame 1.

Therefore, in a normal drive, the lead wires 90, 90 will not collide with the receiving surface 11 of the frame 1, and will not prevent the voice coil 9 from vibrating. This can provide high sound quality and high sound pressure.

Figure 4:
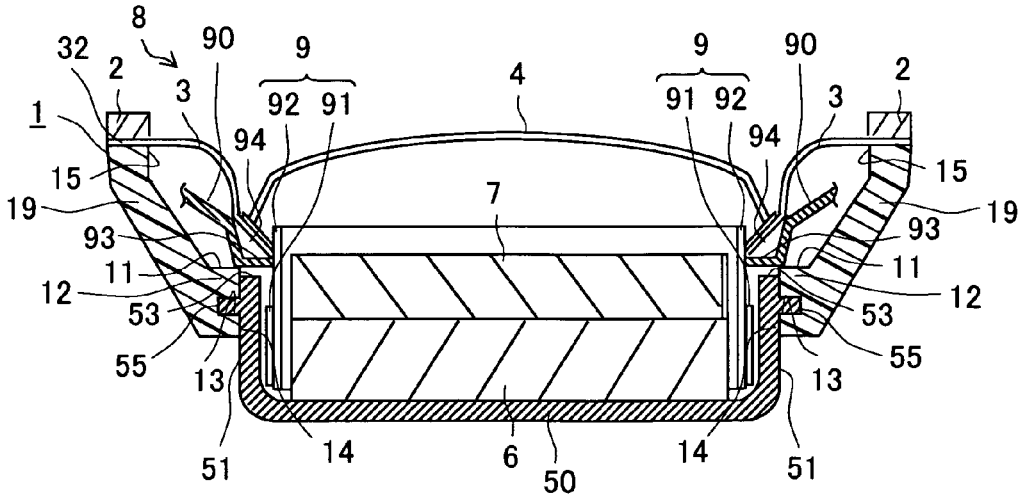
FIG. 4 is a sectional view of the speaker unit of the present invention in a driven state.

If the power supplied to the voice coil 9 contains noise and thereby exceeds the prescribed maximum power, the voice coil 9 vibrates at an amplitude exceeding the prescribed maximum amplitude. However, as shown in FIG. 4, collisions of the lead wires 90, 90 are received by the receiving surface 11. The lead wires 90, 90 are received by the receiving surface 11, and thereby prevented from being further displaced. Therefore, the lead wires 90, 90 will not come into contact with the end face 53 of the yoke 5. This can prevent failure due to short circuit between the yoke 5 and the voice coil 9 and damage of an externally connected drive amplifier.

EXAMPLE

The speaker unit of the present invention was manufactured using the voice coil 9 having vibration characteristics shown in the graph of FIG. 8. As seen from the graph of FIG. 8, when the prescribed maximum power to be applied to the voice coil 9 is set to 1.0 W, the prescribed maximum displacement magnitude of the voice coil 9 toward the yoke corresponding to the prescribed maximum power is 1.0 mm.

The distance W between the base portions 93, 93 of the lead wires 90, 90 and the receiving surface 11 in a non-powered state of the voice coil 9 was formed to be 1.2 mm, with a margin dimension over the prescribed maximum displacement magnitude of 0.2 mm. When a height H from the end face 53 of the yoke 5 to the receiving surface 11 was formed to be 0.1 mm, a thickness D from the outer surface of the bottom 50 of the yoke 5 to the top end of the frame body 2 was 5.4 mm. The height H (0.1 mm) from the end face 53 of the yoke 5 to the receiving surface 11 is a minimum height with which the base portions 93, 93 of the lead wires 90, 90 do not come into contact with the end face 53 of the yoke 5 when collisions of the lead wires 90, 90 are received by the receiving surface 11.

Conventional Example

Figure 5:
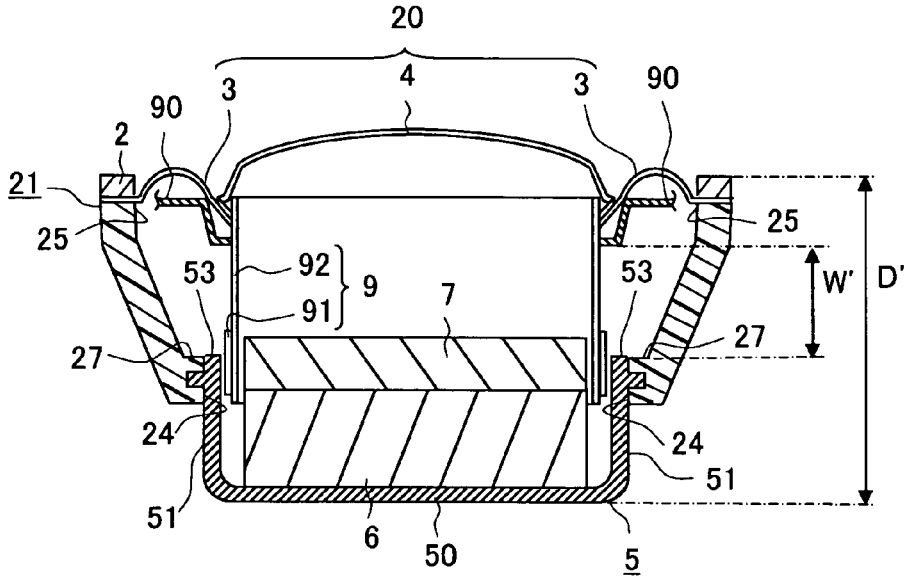
FIG. 5 PRIOR ART
FIG. 5 is a sectional view of a conventional speaker unit.
Figure 6:
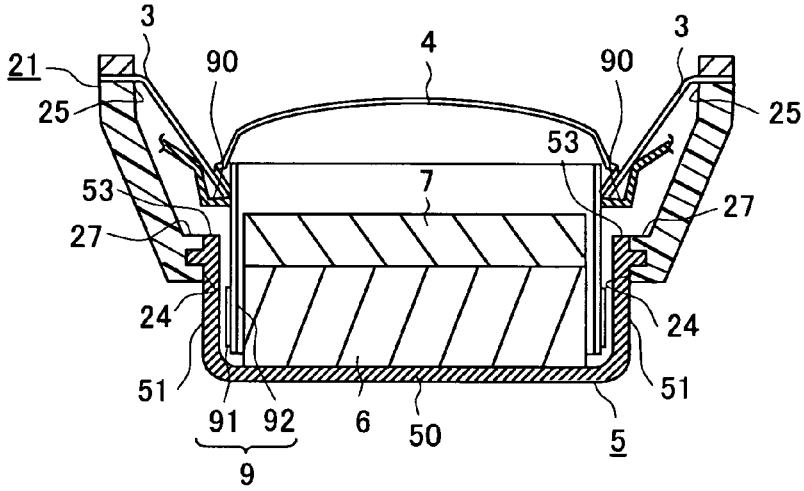
FIG. 6 PRIOR ART
FIG. 6 is a sectional view of the conventional speaker unit in a driven state.
Figure 7:
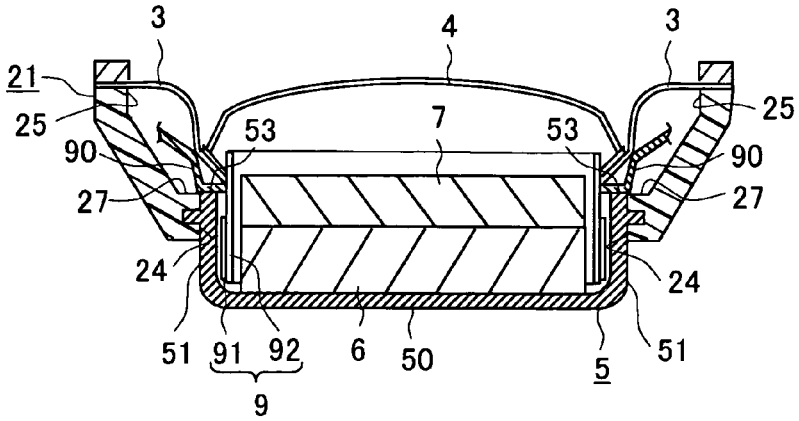
FIG. 7 PRIOR ART
FIG. 7 is a sectional view of another conventional speaker unit in a driven state.

On the other hand, the conventional speaker unit shown in FIG. 5 was manufactured using the voice coil 9 having vibration characteristics shown in the graph of FIG. 8. The conventional speaker unit had the end face 53 of the yoke 5 formed flush with the inner surface 27 of the frame 21. The distance W' corresponding to the saturation displacement magnitude was secured between base portions of the lead wires 90, 90 and the inner surface 27 of the frame 21 in a non-powered state of the voice coil 9.

As shown in the graph of FIG. 8, when the power applied to the voice coil 9 is 2.8 W, the displacement magnitude of the voice coil 9 toward the yoke 5 is 2.1 mm. However, even if the applied power increases from 2.5 W to 3.0 W, the displacement magnitude does not increase to more than 2.1 mm. Therefore, it is understood that the saturation displacement magnitude of the voice coil 9 is 2.1 mm. Except for the frame 21, the same components as of the above speaker unit of the present invention were used. When the distance W' between the base portions of the lead wires 90, 90 and the inner surface 27 of the frame 21 in a non-powered state of the voice coil 9 was formed to be 2.1 mm, the thickness D' from the outer surface of the bottom 50 of the yoke 5 to the top end of the frame body 2 was 6.2 mm.

Thus, the speaker unit of the present invention can have a thickness from the outer surface of the bottom 50 of the yoke 5 to the top end of the frame body 2 made thinner than that of the conventional speaker unit by approximately 1 mm.

The foregoing embodiment is intended to describe the present invention and should not be construed as limiting the claimed invention or reducing the scope thereof. The present invention are not limited to the above embodiment in construction but can of course be modified variously without departing from the spirit of the invention as set forth in the appended claims. For example, the base portions 93, 93 of the lead wires 90, 90 need not be formed perpendicularly with the vibration direction of the voice coil 9, unless the lead wires 90, 90 come into contact with the end face 53 of the yoke 5 when collisions of the lead wires 90, 90 are received by the receiving surface 11. The receiving surface 11 is provided on the entire outer periphery of the end face 53 of the yoke 5 for the above embodiment, but may be provided only at a plurality of areas opposed to the lead wires 90, 90.

What is claimed is:

1. A speaker unit comprising a speaker device 8, and a frame 1 made of a synthetic resin and having an opening in an acoustic wave generating direction of the speaker device 8 to accommodate the speaker device 8, the speaker device 8 comprising a magnet 6; a pole piece 7 and a yoke 5 disposed on opposite polar faces of the magnet 6; an annular space S defined by an outer peripheral surface of the pole piece 7 having a central axis parallel to the acoustic wave generating direction and an inner peripheral surface of the yoke 5, which are opposed to each other; a cylindrical voice coil 9 placed in the space S; and a diaphragm 3 that is coupled to the voice coil 9 and vibrates in the acoustic wave generating direction, the diaphragm 3 having an inner periphery 31 thereof coupled to one end of the voice coil 9, the diaphragm 3 having an outer periphery 32 thereof coupled to the frame 1, the voice coil 9 having a pair of lead wires 90, 90 extended therefrom, passed between the yoke 5 and the diaphragms 3, and led out of the frame 1, the frame 1 having a receiving surface 11 for receiving collisions of the lead wires 90, 90 due to vibrations of the diaphragm 3, which is formed outer than an end face 53 of the yoke 5 opposed to the diaphragm 3, and closer to the diaphragm 3 than the end face 53.

2. The speaker unit according to claim 1, wherein the frame 1 is formed cylindrically, the frame 1 having an inner peripheral surface thereof formed with a flange 12 projecting toward the end face 53 of the yoke 5, and the receiving surface 11 is defined on a surface of the flange 12 opposed to the diaphragm 3.

3. The speaker unit according to claim 1, wherein the yoke 5 is formed in the form of a bottomed cylinder having a cylinder 51 and a bottom 50, the cylinder 51 having an inner peripheral surface thereof opposed to an outer peripheral surface of the pole piece 7, and has the end face 53 on an open end of the cylinder 51, and the magnet 6 is placed on an inner surface of the bottom 50.

4. The speaker unit according to claim 1, wherein a distance W between the lead wires 90 and the receiving surface 11 at the time when the voice coil 9 is non-powered to give a displacement magnitude of zero is set larger than a prescribed maximum displacement magnitude given by a prescribed maximum power supplied to the voice coil 9, and smaller than a saturation value of displacement magnitude given to the voice coil 9 by supply of an excessive power exceeding the prescribed maximum power.

* * * * *